US008536509B2

(12) United States Patent
Borlez et al.

(10) Patent No.: US 8,536,509 B2
(45) Date of Patent: Sep. 17, 2013

(54) SCANNER ARRANGEMENT

(75) Inventors: Yves Borlez, Heure-le-Romain (BE); Laurent Sarlette, Weywertz (BE)

(73) Assignee: BEA SA, Angleur (BE)

( * ) Notice: Subject to any disclaimer, the term of this patent is extended or adjusted under 35 U.S.C. 154(b) by 169 days.

(21) Appl. No.: 12/965,012

(22) Filed: Dec. 10, 2010

(65) Prior Publication Data

US 2011/0315852 A1 Dec. 29, 2011

(30) Foreign Application Priority Data

Dec. 11, 2009 (EP) ..... 09178980

(51) Int. Cl.
*G06M 7/00* (2006.01)
*G01N 21/86* (2006.01)

(52) U.S. Cl.
USPC ..... 250/221; 250/559.06

(58) Field of Classification Search
USPC ..... 250/206, 206.1, 206.2, 221, 559.06, 250/559.12, 559.13; 382/103, 218
See application file for complete search history.

(56) References Cited

U.S. PATENT DOCUMENTS

| | | | | |
|---|---|---|---|---|
| 5,216,476 | A | 6/1993 | Lanckton | |
| 5,331,312 | A | 7/1994 | Kudoh | |
| 5,787,369 | A | 7/1998 | Knaak | |
| 5,835,203 | A | 11/1998 | Ogura et al. | |
| 2005/0207616 | A1 * | 9/2005 | Brad et al. | 382/103 |

FOREIGN PATENT DOCUMENTS

| | | | |
|---|---|---|---|
| DE | 19518978 | | 11/1995 |
| DE | 19525561 | | 1/1996 |
| DE | 19621612 | | 12/1997 |
| DE | 19709799 | | 9/1998 |
| DE | 10203145 | C1 | 1/2002 |
| DE | 102007060303 | A1 | 6/2009 |
| EP | 0749098 | | 12/1996 |
| EP | 1376154 | | 1/2004 |
| FR | 764887 | A | 5/1934 |
| GB | 461633 | A | 2/1937 |
| WO | 0117838 | A1 | 3/2001 |
| WO | 2006011840 | A1 | 2/2006 |

OTHER PUBLICATIONS

Search Report, European Patent Application Serial No. 09178980.0-2215, May 7, 2010, Applicant Bea SA, 8 Pages.
Swedish Patent Office, International Search Report, International Application No. PCT/SE2005/001148, Sep. 27, 2005, 2 Pages.
European Patent Office, International Search Report, International Application No. PCT/EP00/08483, Jan. 23, 2001, 6 Pages.
European Patent Office, European Office Action, Application No. 09178980.0-2215, Applicant Bea S.A., Feb. 15, 2012, 7 Pages.

* cited by examiner

*Primary Examiner* — Georgia Y Epps
*Assistant Examiner* — Don Williams
(74) *Attorney, Agent, or Firm* — Woodling, Krost and Rust

(57) ABSTRACT

The invention relates to a sensor arrangement for scanning a scanning area (16, 36) comprising a scanner (10, 30, 42, 54) that generates a scanning field (12) which is defined between two legs spaced from each other by a scanning angle (A), and which scanner is adapted to control at least one blocking means (18, 38, 50) for a passageway (32, 56), said passageway (32, 56) being delimited at least in its horizontal extension. The invention is characterized in that a scanner (10, 30, 42, 54) is mounted at a distance, as viewed in the passage direction (14), from the passageway (32, 56) and thus also from the controlled blocking means (18, 38, 50), and that the scanning field (12) is directed towards the passageway and extends through the passageway (32, 56).

15 Claims, 3 Drawing Sheets

SCANNER ARRANGEMENT

The present invention relates to a scanner arrangement for automatic control of means used for blocking a passageway according to the preamble of claim 1.

Passageways are often provided with blocking means to make it difficult or impossible for people or vehicles to pass through, for example. To enable expedient use of such blocking means, they should be designed such that they can open the passageway, if necessary.

Automatic control of blocking means such as factory gates, entry barriers, railway crossing gates, sliding doors or the like has proved to be advantageous for many applications. Consequently, there is a vast demand for the automation of blocking means for passageways. Here, the protection of humans and/or vehicles is of major importance, of course. For example, a barrier is to open a passageway as soon as a vehicle approaches, and is not to close again for at least as long as the vehicle remains within the passageway.

Various sensor arrangements for controlling and securing passageways and/or crossings have already been known from the prior art.

Disclosed in DE 10 2007 060 303 A1 is a sensor arrangement for monitoring a railway crossing. As described in this document, a railway crossing is delimited by two pairs of gates and can be closed off by them. This document provides for the presence of a scanner which will generate a scanning field at the edge of the railway crossing, near the first pair of gates, said field extending across the railway crossing towards the second pair of gates which is further away. Preferably, a second scanner is disposed diagonally opposite the first scanner, with the scanning field of the second scanner overlapping the scanning field of the first scanner. Evaluation will then be based on the sectional area of the two scanning fields, thus eliminating the scanning area outside the gates. Consequently, the area in front of the railway crossing and the area of the passageway will not be considered in the evaluation.

DE 102 03 145 C1 discloses the automatic activation of a door controlled by a scanner. In this case, a scanner is mounted near a lateral delimitation of the passageway and will scan the area in front of said passageway. This sensor arrangement is disadvantageous in that it will only allow detection of the area in front of the passageway. For detecting the side of the passageway facing away from the area in front of it, a second sensor will have to be mounted. With this arrangement, the passageway itself will never be scanned—which constitutes a certain safety risk.

It is the object of the invention to provide a scanner arrangement for automatically controlling blocking means which arrangement allows detecting both the area of the actual passageway and the area in front of a passageway in a reliable and simple way.

This object is accomplished by the characterizing features of claim 1.

The subclaims relate to advantageous further embodiments of the invention.

In a known manner, the sensor arrangement for detecting a scanning area comprises a scanner which generates a scanning field defined between two legs that are spaced from each other at a predetermined scanning angle. The scanner arrangement is suitable for controlling at least one blocking means. Moreover, it is known that blocking means are capable of closing or opening a passageway. The passageway is delimited at least in its horizontal extension and has a passage direction. The passage direction is the direction in which a passageway will essentially be crossed or passed through. In the case of a door, the passage direction extends orthogonally to the door step in either direction.

According to the invention, a scanner is provided which is disposed at a distance from said passageway, as viewed in the passage direction. As a result, the scanner will also be disposed at a corresponding distance from the blocking means to be controlled. The scanning field generated by the scanner is directed towards the passageway—which will result in the entire passageway being within said scanning field. Moreover, the scanning field may also extend beyond the actual passageway. Within said scanning field, a scanning area will be defined which constitutes the relevant area to be scanned. According to the invention, the scanning area comprises both the area in front of the passageway and the area of the actual passageway. Moreover, the scanning area may also extend beyond the area of the passageway.

The scanner arrangement according to the invention allows both the area in front of the passageway and the area of the actual passageway to be monitored using only one scanner. A single scanner may thus be the input both for controlling the operation of the blocking means and for safety monitoring, In a particularly advantageous embodiment, the scanner may have a scanning angle of less than 180 degrees. This makes the scanner itself, and thus the entire scanner arrangement, particularly simple and inexpensive to produce without limiting its functionality.

In particular, it is possible to scan the scanning area in several planes. For this purpose, the scanning field angle may be varied relative to the horizontal, and a vertical sweep of the scanning plane can then be performed. Moreover, this will allow simultaneous or successive scanning of plural scanning planes intersecting at different slopes in the scanner.

This has the advantage that—regardless of the height—it will allow the evaluation to always be based on the interfering object that is actually closest to the blocking means. By detecting objects at different heights, it can be ensured that the portion of an object which is closest to the blocking means will also be considered. For example, a scanner having a scanning plane near the ground would only detect the distance of the tires but would not be able to measure the distance of the bumper.

It is considered particularly advantageous to provide for the scanning area to be subdivided into several zones. This will allow safety zones to be defined around the area of the passageway as well as approach or activation zones following said safety zones in the passage direction. The detection of an object in the activation or approach zone may thus trigger an action of the blocking means. If an object is detected in the activation zone, this may for example trigger the opening of the blocking means. Moreover, closing of the blocking means may be prevented or stopped, or the blocking means may even be caused to reopen upon the sudden detection of an object in the safety zone. This will protect humans and vehicles from being harmed or damaged by the blocking means. The safety zone may extend on both sides of the passage direction of the blocking means and moreover additionally also laterally to the passageway.

According to another embodiment of the invention, the scanning area comprises successively—as viewed in a passage direction—a first approach zone, a safety area, the passageway area, a second safety area and a second approach zone. This will allow control of the blocking means from either side.

In particular, the blocking means is designed as a barrier. This barrier will delimit an area of a passageway of the width of the barrier and the diameter of the barrier. Providing the blocking means in the form of a barrier has the advantage that it can readily be penetrated by the scanning planes of the scanner even in its closed state and will thus not interfere with the scanning field. The barrier will be moved in an essentially vertical opening plane. Due to the fact that the barrier does not interfere with any scanning plane, complete scanning is possible during the entire operation time.

As an alternative to the barrier, the blocking means may also be designed in the form of a gate or door which will close in the vertical or horizontal direction. In this case, it is possible to detect entry of the gate into the scanning area of the scanner by means of a software algorithm. This algorithm will differentiate between the pre-recorded movement of the gate or door closure and the trajectory of an object that enters the scanning area, for which reason the gate will not be considered to be interfering with the scanning area.

In case the gate or door is non-transparent to the scanner, an activation zone may only be located on the side of the scanner. A safety zone located on the side facing away from the scanner will remain unaffected thereby as the safety zone will only become relevant once the blocking means has been raised. Then, however, the scanner will be able to view the entire scanning area.

In yet another advantageous embodiment, the sensor is aligned to be flush with the passageway. This has the advantage that when the area of the passageway is laterally delimited by some construction which is impenetrable to the scanner, a scanning area can be generated which is as wide as the passageway itself. The lateral delimitation of the scanning area extends in parallel to the passage direction.

If the sensor were additionally spaced laterally from said passageway for mounting it at a distance as viewed in the passage direction, the impenetrable lateral delimitation would create a shadow on the side of the passageway facing away from the scanner, which would restrict the potential detection range of the scanner.

In another embodiment, the scanner is provided in the form of a laser scanner. The laser scanner will emit detection rays which will be reflected by an object within the scanning field. The resulting echo signal will be detected again by the scanner. Evaluation of the propagation delay will determine the position of the object in the scanning field, and it will thus be possible to establish whether the object is also within the predetermined scanning area, or in one of the defined zones. Depending on the result, the blocking means can be controlled accordingly. In particular, the detection radiation will be in the infrared wavelength range and neither visible nor harmful to humans.

Moreover, a control unit may be provided which is actively connected both to the blocking means and the scanner. The control unit can thus receive and evaluate signals from the scanner. Depending on the evaluated signals, the control unit will define the direction of movement for the blocking means. If required, it may also cause a direction change of the blocking means. A direction change will preferably be triggered when the blocking means is in the closing mode and an object is detected in the safety zone. Then the blocking means will be opened again.

The control unit may also be connected to further components of the passageway system. When an object is detected in the approach zone, this may thus trigger the issuance of a parking ticket, for example, instead of activating the blocking means.

Further advantages, features and potential applications of the present invention may be gathered from the description which follows, in conjunction with the embodiments illustrated in the drawings.

Throughout the description, the claims and the drawings, those terms and associated reference numerals will be used as are notable from the enclosed list of reference numerals.

Figure 1:
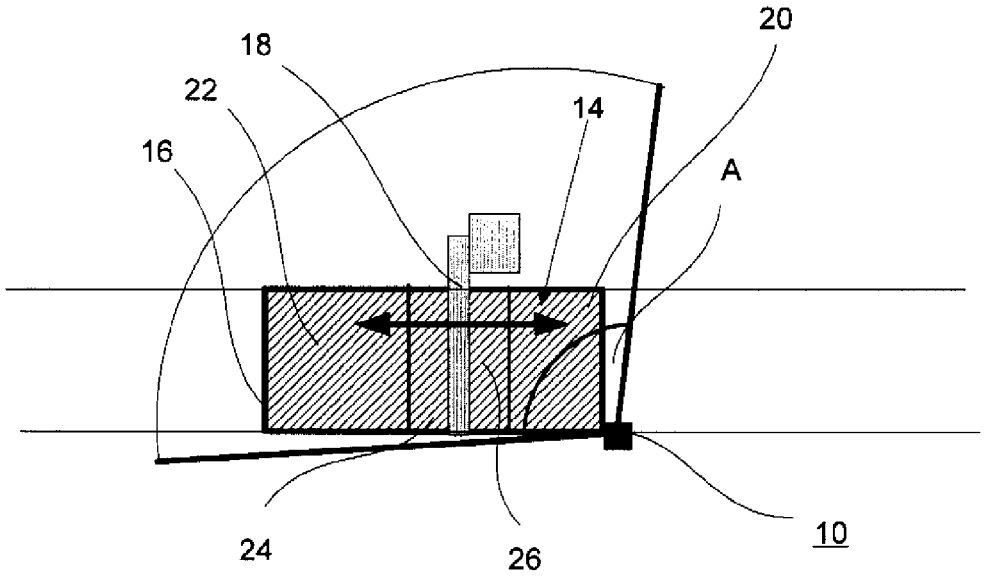
FIG. 1 is a top view of a single barrier arrangement.

FIG. 1 shows the top view of a single barrier arrangement comprising a barrier 18 which can be crossed or passed in a passage direction 40. A sensor 10 is provided for controlling the barrier 18 which sensor 10 will detect any objects present in a scanning area 16. The scanning area 16 is a section of a scanning field 12 which the sensor could potentially cover. The scanning field 12 is defined between two legs which are spaced at an angle A from each other. As the scanning angle A is less than 180°, the scanning arrangement can be produced at low cost.

The scanner 10 is disposed at a distance from the barrier 18, as viewed in the passage direction. Moreover, the sensor 10 is located at a corner of the scanning area 16. The scanning area 16 is subdivided into a first approach zone 20 and a second approach zone 22. Furthermore, a safety zone 24 and 26 each is provided between the approach zones 20, 22 and the barrier 18. The orthogonal extension of the scanning area 16 with respect to the passage direction 14 equals or exceeds the length of the barrier 18.

If, for example, a vehicle is detected in the approach zone 20, then this will result in the opening of the barrier 18. As long as an object remains within the safety zone 26, 24, the barrier 18 will not be closed. Once the vehicle has left the second approach zone 22, and the barrier is closed again, it can be opened again upon detection of an object present in the first or second approach zones 20, 22. A similar behavior would happen if the vehicle would approach from the opposite side.

Figure 2:
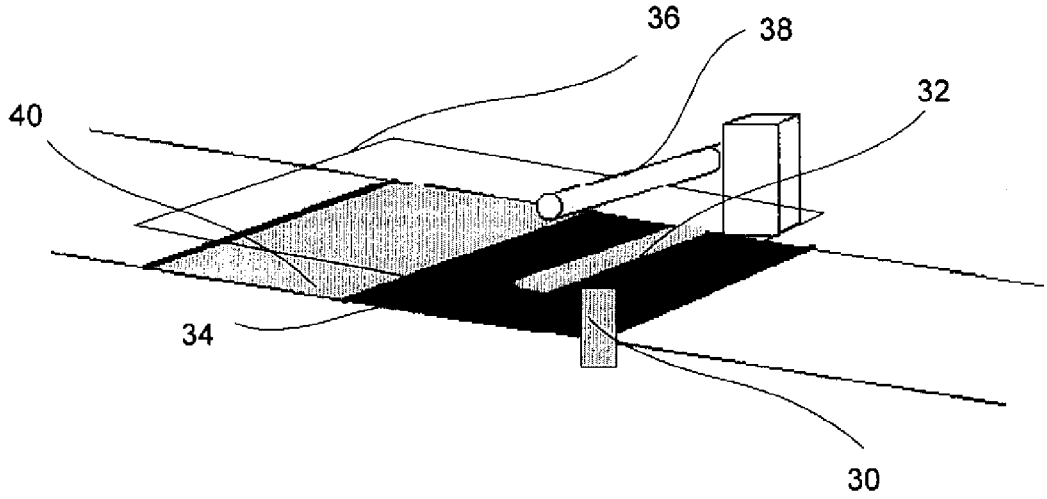
FIG. 2 is a perspective view of a single barrier arrangement.

FIG. 2 shows a perspective view of a single barrier. The scanning field is not illustrated in this embodiment. Merely the scanning area 36 is illustrated here. The scanner 30 is located at a distance from the passageway 32, as viewed in the passage direction. The passageway 32 can be blocked by means of the barrier 38. The scanner 30 is positioned in the corner of the scanning area 36. Extending around the passageway 32 is a safety zone 34 which is followed by an approach zone 38 which is located at an even further distance from the passageway 32. The scanner 30 is thus positioned in the corner area of the safety zone 34.

Figure 3:
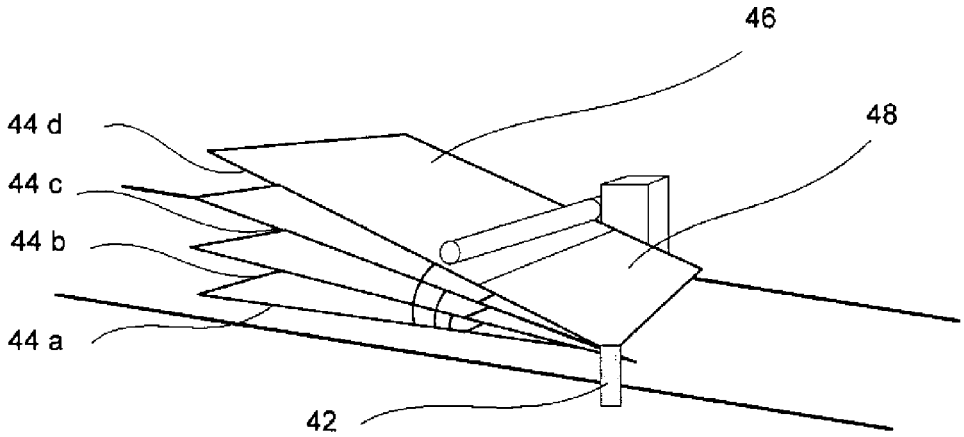
FIG. 3 is a single barrier arrangement including a scanner for several scanning planes.

FIG. 3 shows another perspective view of a barrier arrangement. As a further development of the embodiment of FIG. 2, the scanner 42 used here has several scanning planes 44*a*, 44*b*, 44*c*, 44*d*. The scanning planes 44*a*, 44*b*, 44*c*, 44*d* have different slopes and intersect in the scanner 42. Even the highest scanning plane 44*d* will not be interrupted by the barrier. This will ensure complete scanning of the scanning area, which is subdivided into an approach zone 46 and a safety zone 48, during the entire operation period.

Figure 4:
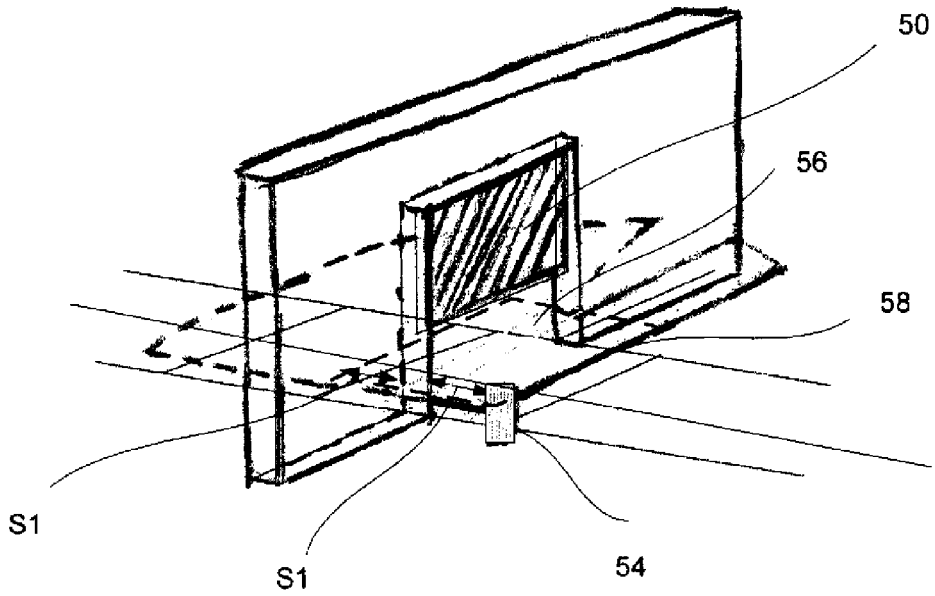
FIG. 4 is a sensor arrangement for a vertically displaceable gate.

FIG. 4 is a view of a scanner arrangement for controlling a gate 50. The gate 50 is capable of blocking a passageway which is delimited by a wall 52. The scanner 54 is mounted at a safety distance S1 from the gate, as viewed in the passage direction. In this embodiment, the scanner is aligned so as to be flush with one side of the passageway. In this case, the scanning area will extend to the distance S1 on the side of the passageway facing away from the scanner. As no activation area has been defined in this case, it will not be a problem that the gate will completely interrupt the scanning area once it passes through it. The safety area will only be relevant—and also be completely visible to the scanner—when the gate is open. When the gate is open, the whole area will be completely visible to the scanner to provide safety. When the gate is closed or opening, there is no need for safety in neither side of the door. When the gate is closing, the safety function can be maintained during most part of the closing time up to the moment where the scanning device will detect the signature of the gate interference with the scanning planes.

In an alternative embodiment, the scanner might be spaced even further from the passageway as viewed in the passage direction, and another activation area might be defined in front of the safety area on the side of the gate where the sensor is.

Figure 5:
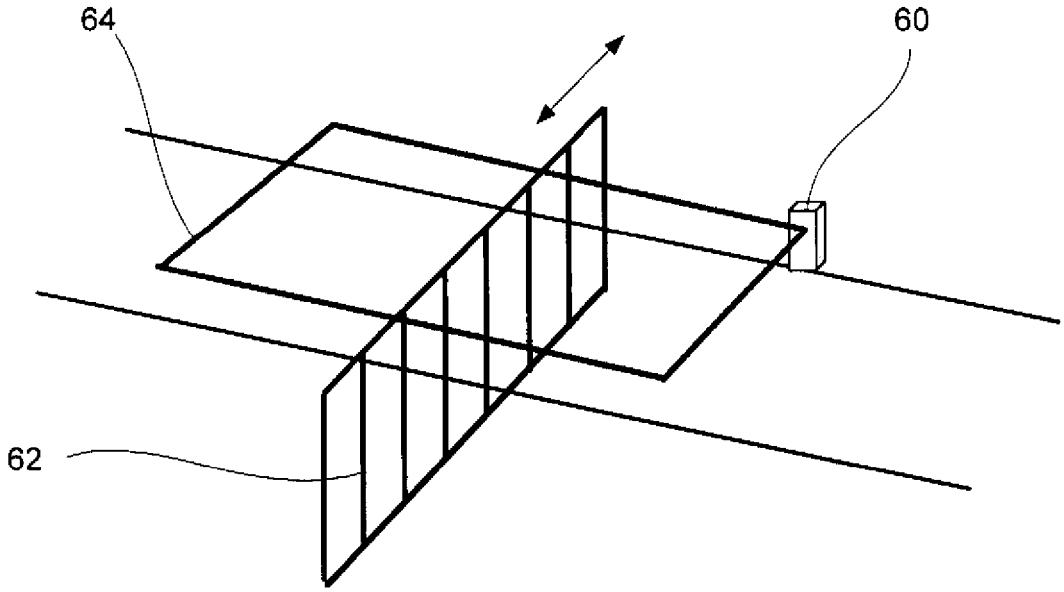
FIG. 5 is a horizontally displaceable barrier arrangement.

FIG. 5 shows a view of a scanner arrangement, comprising a scanner 60 for controlling a gate 62. The gate is capable of blocking the passageway that is delimited by the width of the street by being displaced in horizontal direction. Since the sensor is able to see through the gate, both sides of the gate can be monitored by this sensor arrangement. Although the gate intrudes the scanning area 64 the scanning arrangement is still able to distinguish whether the intrusion is caused by the gate or an entering person or vehicle. When a person or vehicle is detected in the detection area, the scanner arrangement can trigger the gate to open, stop closing, or to reopen. A second sensor placed on the other side of the door or even on the same side, will increase safety according to redundancy of the arrangement.

Multiple applications can be covered by this type of sensor arrangements that comprises a wide scanning area and allows to define different functional zones, like protection or activation areas to control blocking means respectively.

LIST OF REFERENCE SIGNS

10 scanner
12 scanning field
14 passage direction
16 scanning area
18 barrier
20 first activation zone
22 second activation zone
24 safety area
26 safety area
30 scanner
32 passageway
34 safety zone
36 scanning area
38 barrier
40 activation zone
42 scanner
44*a* scanning plane
44*b* scanning plane
44*c* scanning plane
44*d* scanning plane
46 activation zone
48 safety zone
50 gate
52 wall
54 scanner
56 passageway
58 safety zone
60 scanner
62 gate
64 scanning area
S1 safety distance
A scanning angle

The invention claimed is:

1. A sensor arrangement for scanning a scanning area, comprising:

a scanner generating a scanning field, said scanning field is defined between two legs spaced at a scanning angle, (A), from each other;

said scanning field is subdivided into first and second zones, said first zone is an activation zone and said second zone is a protection zone;

said scanner is a laser scanner that emits detection rays which are reflected by an object within said scanning field and due to propagation delay said object is assigned to said first activation zone or said second protection zone;

said scanner controls a blocking means for a passageway, said passageway being delimited at least in its horizontal extension;

said scanner disposed at a distance, as viewed in the passage direction, from said passageway and thus also from said controlled blocking means; and, said scanning field directed towards said passageway and extending through said passageway.

2. The sensor arrangement for scanning a scanning area as claimed in claim 1 wherein said scanner generates a scanning field having a scanning angle, (A), of less than 180° in the horizontal direction.

3. The sensor arrangement for scanning a scanning area as claimed in claim 2 wherein said legs of said scanning field are aligned flush with one of said lateral delimitations of said passageway.

4. The sensor arrangement for scanning a scanning area as claimed in claim 2 wherein objects and/or people are scanned by said scanner in a plurality of planes located in said scanning area.

5. The sensor arrangement for scanning a scanning area as claimed in claim 4 wherein said scanning planes are positioned at different angles from each other and said plurality of scanning planes intersect in said scanner.

6. The sensor arrangement for scanning a scanning area as claimed in claim 1 wherein said legs of said scanning field are aligned flush with one of said lateral delimitations of said passageway.

7. The sensor arrangement for scanning a scanning area as claimed in claim 6 wherein objects and/or people are scanned by said scanner in a plurality of planes located in said scanning area.

8. The sensor arrangement for scanning a scanning area as claimed in claim 7 wherein said scanning planes are positioned at different angles from each other and said plurality of scanning planes intersect in said scanner.

9. The sensor arrangement for scanning a scanning area as claimed in claim 1 wherein objects and/or people are scanned by said scanner in a plurality of planes located in said scanning area.

10. The sensor arrangement for scanning a scanning area as claimed in claim 9 wherein said scanning planes are positioned at different angles from each other and said plurality of scanning planes intersect in said scanner.

11. The sensor arrangement for scanning a scanning area as claimed in claim 1 wherein said protection zone extends across said passageway and across the area adjacent said passageway, and, said activation zone is spaced apart from said passageway as viewed in said passage direction.

12. The sensor arrangement for scanning a scanning area as claimed in claim 1 wherein said blocking means is a vertically or horizontally displaceable gate or door.

13. The sensor arrangement for scanning a scanning area as claimed in claim 1 wherein said blocking means is a vertically or horizontally pivotable barrier.

14. The sensor arrangement for scanning a scanning area as claimed in claim 1 wherein said scanner is aligned to be flush with said passageway.

15. The sensor arrangement for scanning a scanning area as claimed in claim 1 wherein said scanner is a laser scanner.

* * * * *